364-420 SR
8/28/79 XR 4,165,789

United States Patent [19] [11] 4,165,789
Rogers [45] Aug. 28, 1979

[54] DRILLING OPTIMIZATION SEARCHING AND CONTROL APPARATUS

[75] Inventor: Charles D. Rogers, Monroeville Borough, Pa.

[73] Assignee: United States Steel Corporation, Pittsburgh, Pa.

[21] Appl. No.: 920,297

[22] Filed: Jun. 29, 1978

[51] Int. Cl.[2] ..... E21C 1/02; E21C 1/10
[52] U.S. Cl. ..... 175/27; 175/24; 173/6; 173/8; 173/9; 364/420
[58] Field of Search ..... 364/420, 474; 173/4–9; 175/27; 219/1

[56] References Cited

U.S. PATENT DOCUMENTS

| | | | |
|---|---|---|---|
| 3,520,375 | 7/1970 | Raynal et al. | 175/24 |
| 3,593,807 | 7/1971 | Klima | 173/6 |
| 3,613,805 | 10/1971 | Lindsted | 175/27 |
| 3,658,138 | 4/1972 | Gosselin | 173/6 |
| 3,872,932 | 3/1975 | Gosselin | 173/6 |
| 3,971,449 | 7/1976 | Nylund | 175/27 |
| 4,079,795 | 3/1978 | Sackman | 175/27 |

*Primary Examiner*—William Pate, III
*Attorney, Agent, or Firm*—William A. Danchuk

[57] ABSTRACT

An apparatus employed in the searching of the optimized rate of penetration of a drill into a given medium based upon the two drilling parameters of thrust and speed of revolution. Preset base values of both parameters are input into the drilling control mechanism at the start of drilling. Thereafter, based upon readings from an automatic penetration rate calculator, the apparatus effects automatic incremental changes to one of the parameters, the other being held constant, until a maximized rate of penetration is established. Subsequently, the other parameter, previously held constant, is changed until a new maximized penetration rate is found. This optimized penetration rate searching is continuously and automatically effected until the drilling process is completed. The apparatus additionally provides for the allowance of a wait period between successive incremental changes for accommodating response times of the system as well as instabilities which may occur as the result of nonlinear process dynamics.

22 Claims, 7 Drawing Figures

10
12
14
16
18
20
22
24
26
28
30
32
34
36
38
40
42
44
46
48
50
52
54
56
58
60
62
INPUT/OUTPUT INTERFACE
MICRO-COMPUTER
$P_T$
$V_T$
$V_L$
$V_D$
$V_S$
$V_B$
LEGEND:
HYDRAULIC LINES
ELECTRICAL WIRING

DRILLING OPTIMIZATION SEARCHING AND CONTROL APPARATUS

BACKGROUND OF THE INVENTION

A recent renewed interest in coal mining has once again brought out the salient limitations in current procedures for mining coal. Specifically, the most nonproductive segment of time within the coal mining process is associated with roof bolting. The time consumed during this necessary process far exceeds, in proportion, any other time segment dedicated to the other details incorporated within the mining of coal. This delay in the advance of underground continuous mining equipment represents a reduction in mine productivity. Moreover, the instability of the drilling process itself is reflected in the myriad of problems associated with the drilling of roof bolt holes. Specifically, the melting of solder holding the carbide cutting tip on the drill bit, the bending of the drill steel as well as the total lodging of the drill steel within the hole have all resulted in wasted time as well as expense.

The major delay in roof bolting stems from the time consumed in drilling holes for roof bolts. With the present roof drilling machines, the operator utilizes a "feel" of vibration and visual estimates of roof drill penetration rates to adjust the thrust and torque input into the drilling system. While such a nonscientific system produces "adequate" results, the amount of delay in the time consumed in roof hole drilling suggests otherwise. This delay is especially important in other "long" drilling applications. In an ideal situation, the advance of the roof drill into the rock or medium being drilled should be maintained at a maximum penetration rate at all times. It should be obvious from past performances that this optimization has not been obtained.

The specific causes which have resulted in the time consumption inherent in roof bolt drilling comes from an assumed, but incorrect, presumption that roof bolt hole drilling is an art and not a science. This is substantiated in part by the present-day thought that the best roof bolt hole driller is the one man who has the best "feel" for the progress and vibration of the drill and drill steel into the rock. It has recently been determined that the maximized penetration rate of a drill and associated drill steel into any medium being drilled, whether that medium be limestone, sandstone or coal itself, is susceptible to a scientific and logical set of parameters and control algorithms which do in fact result in an optimized rate of penetration into the medium being drilled.

While a variety of prior art is available in this area, none fully appreciate the use of drilling parameters and the values of the drilling parameters which may be manipulated in a specific manner in order to accomplish a maximized penetration rate of the drill into the medium.

SUMMARY OF THE INVENTION

The present invention is addressed to an apparatus dedicated to optimizing the rate of penetration of a drill within a medium to be drilled. The apparatus automatically provides the roof-drill operator with a numerical display of penetration rate during the drilling process and automatically conducts a self-adjustment of the roof-drilling controls to achieve such maximized penetration rate of the drill bit into the medium.

The basis of the present invention resides in an anomally in that the two drilling parameters, i.e., drill thrust and drill speed (RPM), are independently operative variables but have an interdepending relationship with one another. Specifically, the apparatus according to the present invention utilizes a searching program for the optimized penetration rate which encompasses the incremental change of one of the variables noted above while retaining the other variable in a constant state. When the penetration rate has been maximized for the one variable being changed, the process of parameter variability is then automatically applied to the previously unchanged variable while the previously changed variable is held constant. For instance, the RPM of the drill may be incrementally changed in either a positive and negative sense while the thrust is held constant. The RPM is incrementally varied until the penetration rate, as indicated by the calculation apparatus, is stabilized at a maximum reading. Once this stage has been reached the RPM value being input to the drilling apparatus is then held constant while the thrust applied to the drilling apparatus is varied incrementally until a new maximized penetration rate is realized. This process is repeated during the searching cycle of drilling.

The apparatus according to the present invention also incorporates a waiting period between incremental changes in the values of the two drilling parameters before commencing yet another incremental change. The waiting period is utilized to compensate for any changes in the time response of the process being controlled. This is specifically applicable with respect to changes in the response time of the hydraulic system valves. Additionally, changes in the thermal characteristics of the drill/rock interface, i.e., the rate of heat removal, may also affect the response time of the system. The apparatus according to the present invention also provides for a deadband area of insensitivity for the calculation of the penetration rate for permitting stabilization of the drilling procedure to preclude the inclusion, within the calculation of the penetration rate, of instabilities which occur as a result of nonlinear process dynamics. These may occur due to small variances in hardness, etc., of the rock or coal medium being drilled which may change the proportionality between thrust and penetration rate or between RPM and penetration rate.

The apparatus according to the present invention has as its base a microcomputer for calculation of the penetration rate as well as the timing sequence of the incremental changes to the two drilling parameters. This very precise control over the drilling parameters obviates the need for inaccurate and mistaken estimates by the drill operator himself as to penetration rate and the "feel" of vibration and visual estimates of roof drill penetration rate. Due to the precise control over the drilling parameters and the input to the drilling control system, there is realized a much improved speed of penetration of the drill bit into the medium.

Accordingly, it is a general object and feature of the present invention to provide an apparatus dedicated to optimizing the rate of penetration of a drill within a given medium by selectively and incrementally changing the drilling parameters of drill speed and thrust by continually alternatively applying incremental changes in the values of the drilling parameters independent of each other until a maximized penetration rate is realized for each of the parameters with respect to the value of the remaining parameter being held constant.

It is another general object and feature of the present invention to provide an apparatus for drilling and automatically searching for an optimized rate of penetration of a drill within a given medium, based upon the drilling parameters of drill speed and thrust for maximizing the efficiency of energy transfer from the drilling equipment to the drill/medium interface.

It is yet another object and feature of the present invention to provide a control apparatus for drilling based upon the two drilling parameters of drill speed and drill thrust which utilizes specific incremental changes to the parameters and which also includes a given wait time between the incremental changes in the values of the two parameters before commencing yet another incremental change in order to permit stabilization of the drilling procedure and to preclude inclusion within the calculation of the penetration rate of instabilities which occur as a result of nonlinear process dynamics and to compensate for any changes in time response.

Other objects and features of the present invention will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features that are considered characteristic of the invention are set forth with particularity in the appended claims. The invention itself, however, both as to its structure and its operation together with the additional objects and advantages thereof will best be understood from the following description of the preferred embodiment of the present invention when read in conjunction with the accompanying drawings wherein:

DETAILED DESCRIPTION OF THE INVENTION

Figure 1:
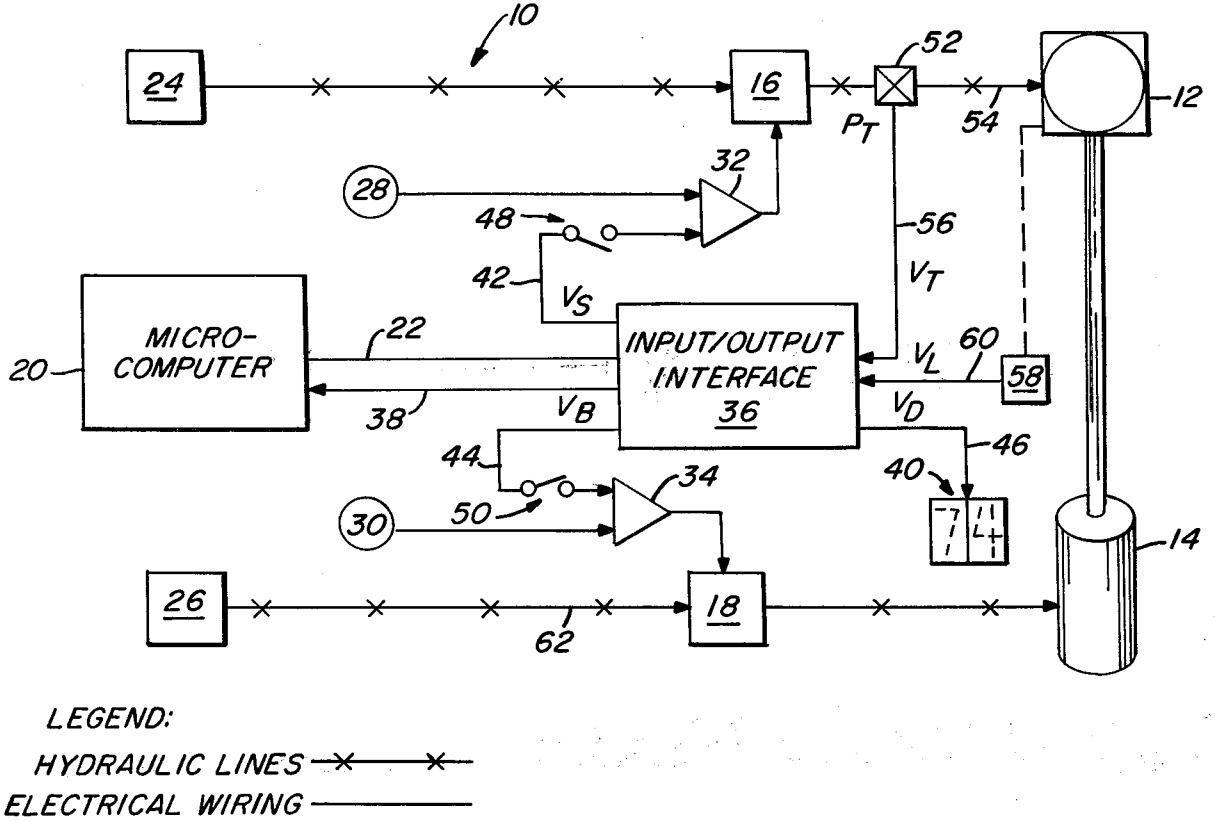
FIG. 1 is a functional block diagram of a microcomputer-based drill control system according to the present invention.

Referring to FIG. 1, there is shown a functional block diagram of a microcomputer-based drill control 10 according to the present invention. The output of the microcomputer-based drilling control is employed to effect the input to a drill motor 12 and a thrust cylinder 14. The drill motor 12 is used to rotate the drill bit and drill steel while the thrust cylinder 14 provides the necessary force to the drill bit in the direction of drilling.

The drill head 12 is fitted with electrically operated hydraulic valves which, in turn, are operated by signals from an operator's control panel. Two such hydraulic valves are presented at 16 and 18. Valve 16 is a pressure compensated electrohydraulic flow valve while valve 18 is an electrohydraulic pressure reducing valve. The signals generated from the operator's control panel to the two hydraulic valves 16 and 18 are augmented with electrical voltages from a microcomputer 20. In a preferred embodiment of the present invention, the microcomputer 20 is a Motorola Model 6802 microprocessor. Through means of a special control algorithm stored within the microcomputer memory, the output voltages from the computer via electrical line 22 are used to manipulate the drill rotational velocity (RPM) and vertical thrust (B). The control algorithm is employed to calculate the RPM and thrust so as to maintain a maximum rate of penetration (feet per minute) as the drill is operated in various rock types.

In operation, the present invention, through use of the microcomputer 20, develops a practical system which is capable of providing optimum control of the roof drilling operation. In this case, optimum control implies the fastest or optimum drilling rate in terms of the constraints imposed by the rock type, bit and rod conditions, chip size, and available torque and thrust. Such controls, when implemented, will provide safer and a more efficient drilling operation. Furthermore, a more uniform action of the control compared with manual operation will reduce bit and rod abuse. These advantages will be reflected as direct reductions in delay at the coal face and therefore represent advantageous increases in productivity.

Positioned on the operator panel (not shown) are two manually reversing drill valves 24 and 26. The drill valve 24 effects rotation of the drill bit while valve 26 is a hydraulic control over the vertical motion, i.e., thrust applied to the drill bit. Electrically driven operator controls as at 28 and 30 permit manual control by the operator of the RPM and thrust during the drilling sequence. The manually operated reversing valves as well as the operator controls are employed for permitting the manual initial positioning (collaring) and withdrawal of the drill while the microcomputer controls the actual drill advance after collaring has been achieved. The two electrohydraulic valves 16 and 18 which are in series with the manual reversing valves are used to provide precise control of the drilling rotational speed (RPM) and thrust (B). These valves are set from an operator's panel to regulate the hydraulic oil flow to the drill motor and oil pressure to the drill thrust cylinder respectively. The operator RPM control 28 and the operator thrust control 30 are electrically connected to two valve amplifiers 32 and 34 respectively. These valve amplifiers are necessary inasmuch as the voltages being output from the operator controls are insufficient in and of themselves to effectively drive the pressure compensated electrohydraulic flow valve 16 and the electrohydraulic pressure reducing valve 18.

Positioned in both an input and output relationship with the microcomputer 20 is an input/output interface 36. The interface 36 receives the output from the microcomputer 20 through the previously mentioned line 22 while the microcomputer 20 receives its input from the interface 36 via an electrical line 38. The input/output interface 36 functions as a digital logic to analog logic converter through line 22 while at the same time acts as an analog to digital converter via line 38. Consequently, the inputs received by the interface 36 (which will be described shortly) are in analog form and must be converted to digital form before being passed to the digital microcomputer 20 via electrical line 38. In much the same manner, the output of the interface (which again will be described in further detail below) must be in analog form. The digital output from the microcomputer 20 must be converted to analog form by the interface 36 prior to its passage to the valve amplifiers 32 and 34. This is not the case, however, with respct to a visual display unit indicated generally at 40. The output from the input/output interface 36 are connected to the valve amplifier 32 via an electrical line 42. The output of the interface 36 is connected to the valve amplifier 34 via a second electrical line 44 and a third output of the interface to the digital display unit 40 is made via an electrical line 46. As indicated in FIG. 1, toggle switches 48 and 50 are provided between the line 42 and the valve amplifier 32 and between the line 44 and valve amplifier 34, respectively. The switches 48 and 50 are provided to permit a solely manually operable drilling operation or any portion thereof. The computer output along line 42, labeled $V_S$, is indicative of an analog voltage along electrical line 42 to the summing junction of the electrohydraulic valve amplifier 32. Similarly, the output voltage indicated as $V_B$ along line 44 to the electrohydraulic valve amplifier 34 is an analog voltage output from the interface 36 to the summing junction of the amplifier 34. A digital voltage $V_D$ applied along line 46 to the display unit 40 is used to illuminate the rate of penetration (FPM) display.

As indicated in FIG. 1, the inputs to the input/output interface 36 come from two sources. The first source of input to the interface 36 is derived from a pressure transducer 52 positioned between the electrohydraulic flow valve 16 and the drill motor 12. The pressure transducer 52 measures the hydraulic pressure along the hydraulic line 54 running between the flow valve 16 and the drill motor 12 and provides a voltage signal $V_t$ along line 56 to the interface 36. The second input signal to the interface 36 is derived from a string potentiometer 58 which measures the movement of the drill bit and drill steel into the medium being drilled. The string potentiometer 58 provides a voltage signal $V_L$ along electrical line 60 to the input/output interface 36. Both of the voltages $V_L$ and $V_t$ are analog voltages which are converted to a digital value by the interface for use in the computer control calculations.

As alluded to previously, the values of the drilling parameters of thrust and RPM being input into the drill motor and thrust cylinder are hydraulically actuated along the lines 54 and 62. The specific manner in which the hydraulics are used to control the drilling parameters is derived from the electronics of the apparatus shown in FIG. 1.

The high speed capability of the microcomputer 20 provides a calculation power to repetitively conduct many control functions within a few hundredths of a second. In a preferred embodiment of the present invention, the microcomputer 20 executes approximately one thousand operations in 0.03 seconds. The drill logic and control functions which are repetitively executed within this time period include (1) a status and reasonability check of all operator switch positions; (2) a precise monitoring of the drill displacement and a computation of the feet per minute which is indicated in the display unit 40; (3) calculations that apply a classical optimal gradient algorithm for determining the correct combinations of drill, RPM and thrust to maximize the penetration rate; (4) transmission of the proper combination of electrical signals to operate the hydraulic valves and to display the current value of the penetration rate indicated on the display unit; (5) a monitoring of the current drill displacement and a comparison of such displacement with the preprogrammed limit of travel; and (6) a monitoring of the drill motor hydraulic pressure. A detailed explanation of the optimal gradient strategy incorporated within the present invention will be discussed below.

Figure 2:
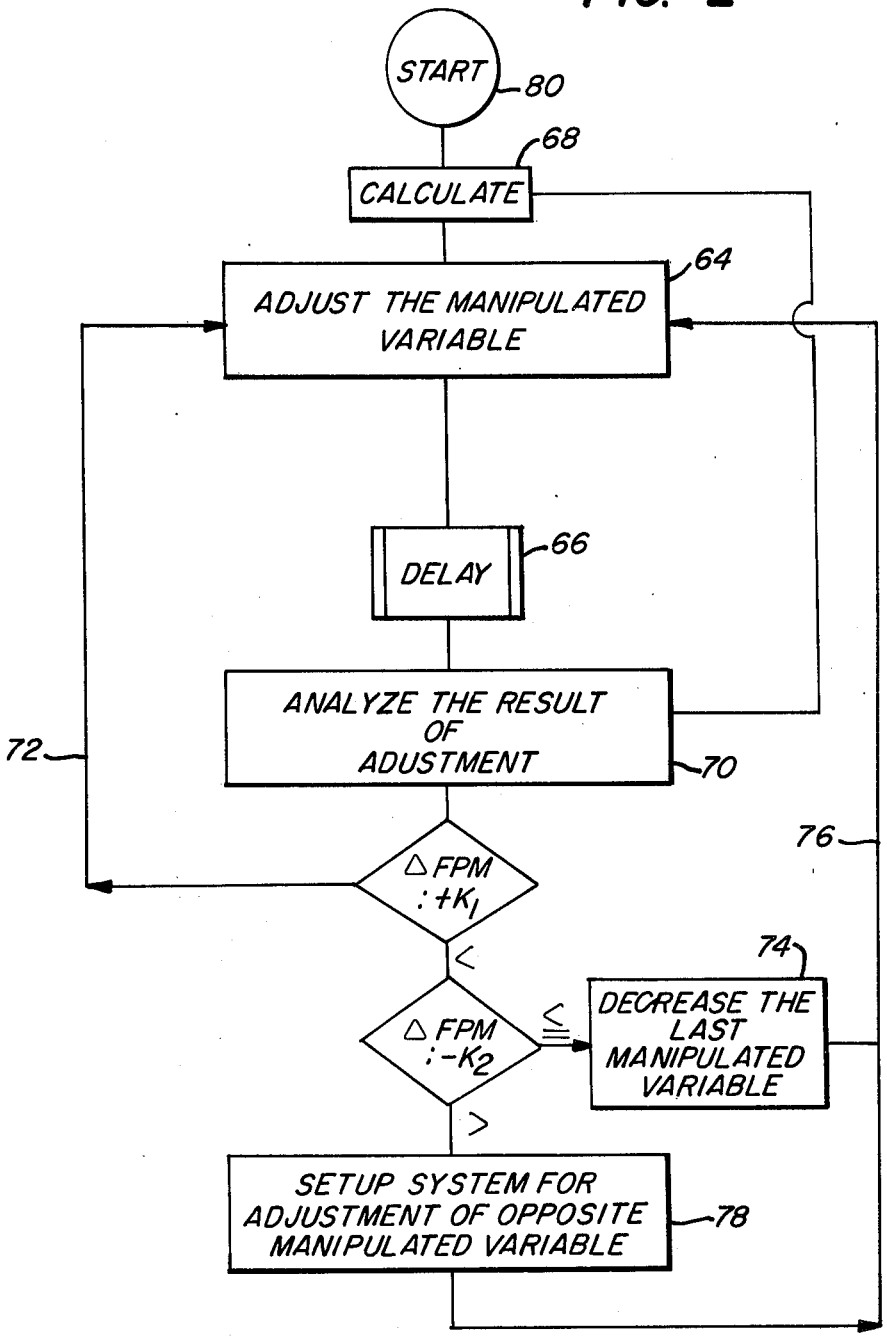
FIG. 2 is a functional flow diagram of a simplified optimal gradient method employed within the apparatus of the present invention.

Looking to FIG. 2, there is shown a flow diagram of a simplified optimal gradient method employed in and forming the basis of the present invention. In operation, once the roof drill is advanced into the rock by a few inches, a state referred to in the art as collared, the optimizing control searching program is activated as indicated by the start command 80 in FIG. 2. The program is set to effect alternative increments either to the amount of drill thrust or rotational speed by a programmed amount. At the start of the drilling procedure, just after the drill is collared, preset values for both thrust and RPM are employed in the drilling program. Subsequently, one of the drilling parameters is manipulated as is indicated by box 64 in FIG. 2. Once the variable or parameter has been manipulated one increment, a brief wait period or delay indicated by box 66 is effected. The feet per minute advance of the drill into the medium being drilled is calculated precisely and compared with the previously calculated value. This calculation is represented by boxes 68 and 70 in FIG. 2. If the results of this comparison indicate that the last variable manipulated (either the thrust or drill speed) has provided a measurable improvement in the penetration rate, that variable is again incremented. Otherwise, depending upon the magnitude of the measurement, that variable is decremented by one-half, kept the same or the opposite variable is incremented. The analyzation of the result of the adjustment of one incremental change to one of the parameters is indicated by box 70 in FIG. 2. Should a change in the penetration rate ($\Delta$ FPM) be at least equal to a constant $K_1$, a signal is provided to the adjusting box 64 via a line 72 to again increase the incremental change. Should however $\Delta$ FPM be less than or equal to a negative constant $K_2$, there is a command given to the adjustment box via a command indicated at 74 and line 76 to adjust the previously manipulated variable in accordance with the change in the penetration rate. As indicated at 78, once the varied parameter has resulted in a maximization of the penetration rate, a setup system for adjustment of the opposite manipulated variable or parameter is provided for making appropriate incremental changes (along with appropriate delays) to the adjustment command indicated by box 64. This second parameter is incrementally varied in a similar manner as the first parameter was varied until an optimized penetration rate is realized. This process is continually repeated during the drilling of the medium. First one parameter is incrementally varied while the other is kept constant and then the situation is reversed so that the once static variable is changed while the previously varied parameter is held static or constant.

The choice of an algorithm for the control of the roof drill is a result of the hypothesis that the describing function for rock drilling is a three-dimensional relationship having a single optimum. The control variable efficiency of the drilling operation, as inferentially described by the rate of drill penetration (FPM), achieves a maximum steady state value and is a function of the two manipulated variables of drill rotational velocity (RPM) and thrust (B). The long-term variables which form a part of the drill operating conditions and average rock characteristics remain relatively constant and therefore are assumed at a steady state during a one-hole drilling. Short-term or insignificant changes in drilling conditions are regarded as process noise. Significant increases in rock hardness are treated during the program process as temporary and a control override is implemented within the present method.

The drilling control method employed within the apparatus of the present invention employs an evolutionary optimization theory which is particularly amenable to steady-state optimization of a poorly defined process such as rock drilling. A number of theoretical strategies are available within the evolutionary optimization method, the choice of which is dependent on such factors as inherent process stability, noise, computer capacity, and the type of constraints imposed upon the system. The current strategy chosen under the evolutionary optimization theory for the drilling process is a discretized (incremental stepping version) of th optimal gradient strategy. As currently implemented within the present invention, this algorithm is relatively simple and slow acting. As will be discussed below, because of stability considerations brought about by nonlinear process dynamics, slow action has proven an advantage to the system as programmed. The simple form of the algorithm is also maintained to facilitate programming into a microcomputer memory and yet has the advantage of consuming only a minimal amount of program memory.

Figure 4C:
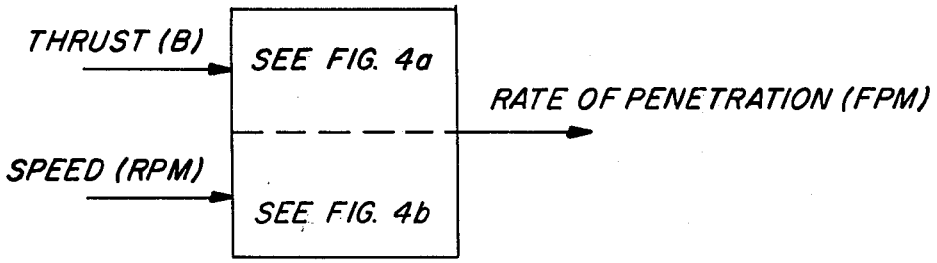
FIGS. 4*a*, 4*b*, and 4*c* are assumed transfer relationships between the manipulated and control variables of the drilling process which form the basis of the present invention.
Figure 4A:
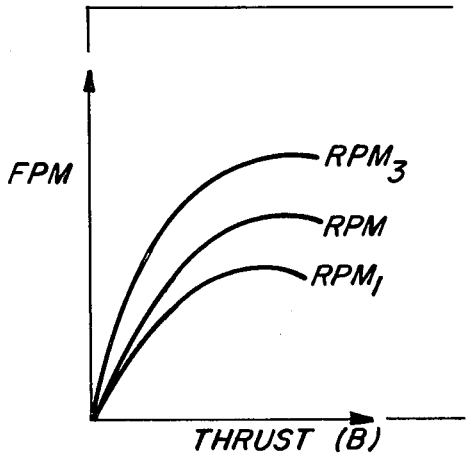

As previously noted, the necessity for the algorithm is predicated on the existence of a three-dimensional relationship between efficiency or rate of drill penetration (FPM) and the independent variables or parameters of drill speed (RPM) and thrust (B). Taken independently, the drill speed and thrust parameters were assumed to be related to the rate of penetration by relationships similar to those shown in FIGS. 4*a* and 4*b*. In FIG. 4*a*, the efficiency of energy transferal from the drilling equipment to the actual rock penetration (as described by the rate of the drill penetration (FPM)) increases with thrust (B) at constant values of $RPM_n$. Once the drill is fully collared, the maximum penetration rate occurs wherein further increases in thrust cause the rate of penetration to remain constant or to decrease. A few conceivable factors contributing to this reduction in efficiency include:

1. The drill rod begins to bend within the hole and therefore energy is consumed in overcoming friction on the hole side.

2. With higher normal forces on the drill bit, the cutting edges are degraded to the extent that cutting effectiveness is reduced.

3. Principally in dry drilling, the nonoptimum cutting method produces chip sizes which result in a situation in which removal methods become ineffective. Looking to FIG. 4*b*, a similar relationship is assumed between the rate of penetration and RPM at constant values of thrust ($B_n$). The factors which contribute to the existence of a maximum on this family of curves may include:

1. The energy level is producing heat at a faster rate than it may be removed. Thus the bit cutting effectiveness is reduced by operating the bit at too high a temperature; and 2. Increases in a bit rate of rotation produce a non-optimized chip volume of a given chip size. Again, an increased amount of energy is consumed as resultant friction between the drill rod itself and the chips existent within the hole sides.

By combining the two functions relating RPM and thrust to the rate of penetration, a three-dimensional relationship has been developed for application to the evolutionary optimization theory.

Figure 3:
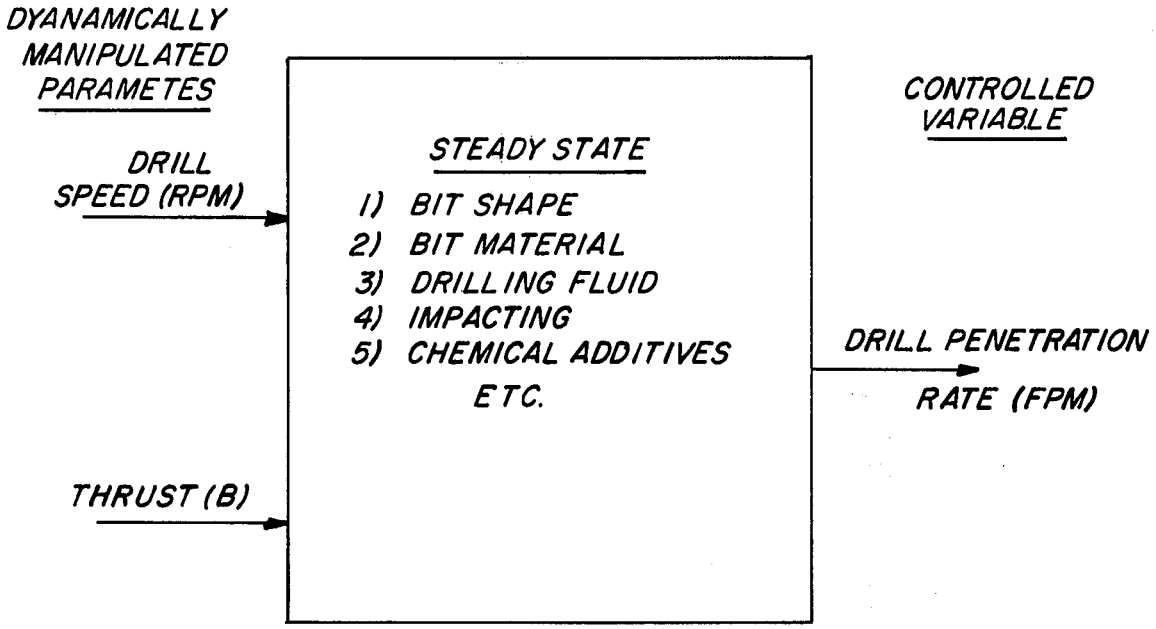
FIG. 3 is a further flow diagram indicating the parameters incorporated within the present invention.

Applicant's experimental confirmation of the relationships of penetration rate to drill speed and thrust (FIGS. 4*a* and 4*b*, respectively) were successful. Data was collected during periods of steady-state running of the drill as the drill progressed into the medium. The penetration rate was recorded for specific drill speeds and thrust settings. The results from such data collection resulted in a conclusion that the steady-state data does not reflect a requirement in which the RPM and thrust must be manipulated along an optimum acceleration trajectory in order to maintain drill stability between each steady state. Rather, it was determined during the experiments that the RPM and thrust must be increased in a manner consistent with the changing process constraints and thereby avoid possible process instability. During some moves for data gathering, process instability was evidenced by overheating of the drill bit, bending of the drill rod or sticking of the drill rod in the rock. The steady-state conditions are evidenced by the flow diagram in FIG. 3.

Figure 4B:
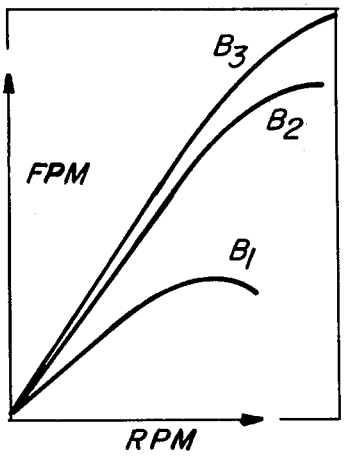

The practical value of applicant's attempts to substantiate the graphs noted in FIGS. 4*a* and 4*b* by the generation of steady-state data was the development of the following set of five control algorithms specifications. In essence, the computer control algorithm is required to (1) act independently of highly nonlinear process dynamics; (2) conduct independent manipulations of each variable (RPM or B) after that particular variable has been determined to provide the most improvement in drilling efficiency (feet per minute) at each state of the process. In effect, this action of the control determines the optimum trajectory for drill acceleration in real time; (3) arrive at and maintain a final maximum rate of drill penetration (feet per minute) once the drill rod is fully collared; (4) protect against substantial changes in the describing function due to effects of highly stratified rock characteristics; (5) implement a means to prevent computer control action as a result of measurement noise or insignificant changes in rock characteristics.

The computer control algorithm requirement of action independent of the highly nonlinear process dynamics is achieved by providing for a wait period or computer control delay which is executed between each manipulation of the thrust or drill speed. Thus, the drill penetration rate achieves a new steady-state value before an analysis of the effect of each manipulation is conducted. Adjustment of the delay length or wait period is dependent upon several factors including electrohydraulic system response, thermal time constant of the drill bit, and collaring depth of the hole. In a preferred embodiment of the present invention, this wait period is in the area of five seconds. It is this wait period which precludes instabilities which may occur as the result of nonlinear process dynamics.

The computer control algorithm requirement of the conduction of independent manipulations of each variable for manipulation along the optimum trajectory to the final maximum rate of penetration is achieved as follows: Once preset values of thrust and RPM are reached, the control appparatus increments the thrust or drill speed by fixed amounts. This action is continued until a negligible amount of improvement occurs in the penetration rate. Subsequently, this same process is repeated with the variable or parameter which had been previously retained in a steady or static condition. The system continues to alternate back and forth between the manipulated variables until the final hole depth is reached. If during this iterative process the rate of penetration decreases as a result of an increment in RPM or thrust, either a full or one-half decrement occurs in that particular variable dependent upon the magnitude of the rate of penetration decrease. Once it has been determined that the rate of penetration is at an absolute steady-state maximum, the control system for the drill continues to search for an optimum in the event that a significant change occurs in rock characteristics and/or drill operating conditions.

The computer control algorithm requirement for protection against substantial changes in the describing function due to highly stratified rock characteristics is achieved through a unique override system. Abrupt increases in hardness of the rock which occur during computer operation would be reflected (unless contained) as a hazardous condition of torque on the drill steel. The override provided within the computer control algorithm differentiates the hydraulic pressure in the drill motor line with respect to time and cancels or withdraws the current or last increase in drill thrust (B). This action occurs at the instant the differential exceeds a preprogrammed constant. In a preferred embodiment of the present invention, this override of torque limiting is set at changes in pressure greater than 300 psi per second of the hydraulic pressure in the drill motor line. It must be noted under such circumstances, however, that the computer control continues to search for the maximum penetration rate identified by the new describing function. As indicated in the functional block diagram of FIG. 1, the hydraulic pressure in the drill motor line 54 is used as an input variable to the microcomputer system via the pressure transducer 52 and its voltage $V_t$. $P_t$ is time sampled by the computer at a period considerably shorter than the maximum system time constant for wait period. For instance, in a preferred embodiment of the present invention, $P_t$ is time sampled by the computer at one second intervals. If the differential $\Delta P_t/\Delta$ time exceeds the predetermined limit of 300 psi per second, either the current or previous increment of drill thrust is negated.

The computer control algorithm requirement of avoidance of control action occurring as a result of electrical measurement noise, insignificant changes in rock characteristics or insignificant changes in drilling conditions is met by the provision of a deadband within the control actions which prevents computer control action of the thrust and RPM for changes in the penetration rate of the drill which are less than or equal to one-half foot per minute. This deadband range is important in that it obviates the need for computer control action during such insignificant changes in rock characteristics or in drilling conditions as a whole.

The microcomputer-based control implements the overall control algorithm with the increment or decrement size, length of wait period, deadband, and constant for torque override set at values to be satisfactory for experimental running. These values have been previously noted for the preferred embodiment of the present invention but may be varied according to the requirements set during any set of drilling conditions. Modifications of these constants or control logics may easily be implemented by simple changes within the microcomputer programmable memory.

Figure 5:
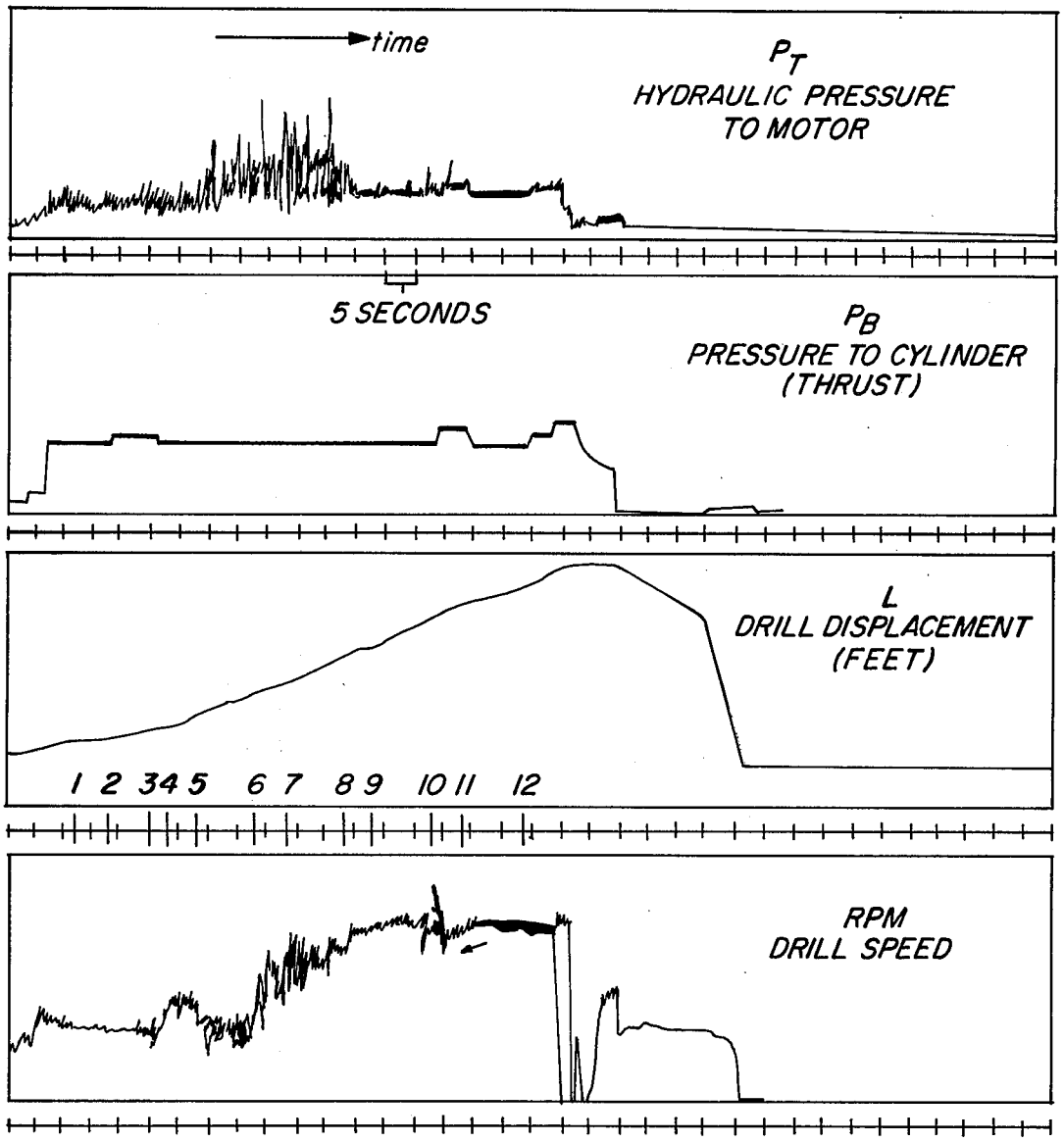
FIG. 5 is a series of charts indicating an empirically-derived interrelationship between the hydraulic pressure channelled to the drill motor, the drill thrust, the rate of penetration and the speed of the drill.

Looking to FIG. 5, there is shown a series of curves based upon empirically derived measurements of the variables noted therein. It is important to note with regard to FIG. 5 that each particular recording or channel is identified with the variable being recorded on a relative scale. The horizontal coordinates relate to time with time increasing in the direction of the indicated arrow. In order to place the variables noted in FIG. 5 in proper perspective, it should be noted that $P_t$ is the hydraulic pressure proportional to torque input into the drill motor, $P_B$ is the hydraulic proportional to thrust, the drill displacement L is the amount of vertical displacement of the drill or $\Delta$ L over $\Delta$ t which is equal to the rate of penetration and RPM is the rotational velocity of the motor. The specific effect upon the drill displacement at given points will be indicated by numerals.

Even though the hardness of the rock being drilled had major changes throughout the drilling operation, an optimum penetration rate was maintained. Additionally, through all its severe excursions in the torque, the drill penetration rate was maintained stable by the computer control and the drill bit itself remained in good condition after drilling of several holes. Overall, the penetration rate for the tests performed, averaged between three feet per minute and six feet per minute. Once the drill had been collared, the computer control was initiated at point 1. At this instant, the initial values for thrust and motor speed had stabilized. At point 2, the initial incremental increase in thrust ($P_B$) of a 150 psi occurred. After a five second wait period a second increase was called for. However, the first rise in $P_t$ (see arrow on chart) negated the increase. A second "spike" in $P_t$ decreased the thrust to its nearly original value at point 3. At that time, the computer control was about to increase the RPM. At point 4, the increase occurred but after a five second analysis of penetration rate the RPM increase was withdrawn at point 5. Between points five and six, an increase in thrust was prevented by the large excursion in $P_t$ (greater than 300 psi per second). In other words, the override provision of the present system became effective. At points 6 and 7, increases in RPM caused a computed increase in the penetration rate. Between points 7 and 8, an additional attempt to increase thrust was negated. This again was caused by a spike in $P_t$ and the override provision came into operation. Points 8 and 9 represent increases in the RPM and point 9 takes the RPM above its high limit which is also beyond the optimum penetration rate as well. Approximately five seconds after point 9, the RPM decrease takes the RPM just below the upper limit (note the arrow on the RPM scale). At point 10, an increasing thrust is attempted and at point 11, the increase is removed because of the decrease in penetration rate that occurred as a result of the thrust increase. At point 11, the RPM is driven again to its upper limit. Continued increases in thrust occurred after point 12 until the top of the rock was reached.

The graphs indicated in FIG. 5 evidence an independent nature to the RPM and thrust incremental changes in the searching function of the present control system for the optimized penetration rate. In addition to an optimization of the penetration rate, there was realized a concomitant prevention of drill bit deterioration as well as the prevention of bending of the drill steel or drill rod. Therefore, the present invention not only provides for an optimized penetration rate but also prevents increases in downtime due to undesirable breakdowns in either the drill bit itself or the drill steel or drill rod.

In conclusion, it should be realized that the drilling control system of the present invention indicates a process for control of the roof drill in an optimum manner while displaying the results of the drilling operation to the drill operator. Drill bit deterioration as well as drill steel bending is prevented. More importantly, however, the weak link in any drilling operation, i.e., the time required for the penetration of a drill into a medium, is greatly shortened due to a realization of an optimized penetration rate for the drill. The present control system provides for a totally automated high productivity drilling. The present apparatus may also provide for remote operation of the drills which would greatly reduce the hazards of roof falls to the drill operator. The holdup time reductions resulting directly in increases in productivity should be obvious. However, the indirect advantages realized from the present drilling method save additional expenses related to the abuse normally exacted upon the drilling operation under previously manually controlled systems.

While certain changes may be made in the above-noted apparatus without departing from the scope of the invention herein involved, it is intended that all matter contained in the above description or shown in the accompanying drawings, shall be interpreted as illustrative and not in a limiting sense.

I claim:

1. Apparatus for controlling functions of a drilling apparatus and automatically searching for an optimized rate of penetration of a drill into a given medium based upon the two drilling parameters of thrust and rotational drill speed, said apparatus comprising:

means for applying a given preset start-up value for each drilling parameter to the drill apparatus;

means for continuously calculating the rate of penetration of the drill into such medium based upon the two parametric values being input into the drill apparatus at any given time; and means for continually and alternatively applying incremental changes in the value of a first drilling parameter to the drill, while keeping the second drilling parameter constant until the rate of penetration of the drill into the medium is maximized for such first parameter and for applying incremental changes in the value of the second drilling parameter to the drill while keeping the first drilling parameter constant until the rate of penetration is maximized for such second drilling parameter.

2. The apparatus according to claim 1 in which said apparatus further includes means for providing a wait period between incremental changes in the values of the two drilling parameters before commencing yet another incremental change in order to permit stabilization of the drilling apparatus and operation and to compensate for response times of the apparatus.

3. The apparatus according to claim 2 wherein the means for providing a wait period is configured to provide a five second wait period between successive incremental changes to each of the two drilling parameters.

4. The apparatus according to claim 1 in which the means for applying the incremental changes to one of the parameters is configured to do so independently of the value of the other parameter being held constant.

5. The apparatus according to claim 1 in which the means for applying incremental changes in the values of both parameters is configured to provide increases as well as decreases in the value of the parameter being changed.

6. The apparatus according to claim 5 in which the means for applying incremental changes in the value of each parameter is operative to increase such input values until the calculated rate of penetration ceases to increase the means for applying incremental changes then being operative to decrease the parameter value or hold such value constant until the maximum calculated penetration rate stabilizes at a relative maximum for the two parameter values being input into the drill.

7. The apparatus according to claim 1 wherein the apparatus further includes means for periodically reading torque pressure to the drill and automatically overriding the last parameter incremental change when the change in torque is greater than a given preset value for preventing damage to the drill.

8. The apparatus according to claim 7 wherein said torque reading means overrides the last parameter incremental change when the change in torque is greater than 300 psi/sec.

9. The apparatus according to claim 1 wherein the means for calculating the rate of penetration of the drill into the medium includes means for providing a dead-band area of insensitivity for the calculation of the penetration rate which precludes additional incremental changes in the parameter values due to minor instabilities which occur as a result of the nonlinear process dynamics of drilling.

10. The apparatus according to claim 1 wherein the means for applying incremental changes is configured to change the thrust values in increments of to $\pm 100$ psi and the RPM parameter values in increments of $\pm 50$ RPM.

11. Apparatus for controlling drilling and automatically searching for an optimized rate of penetration of a drill within a given medium, based upon the drilling parameters of drill speed and thrust, and for maximizing the efficiency of energy transfer from the drilling equipment to the drill/medium interface, said apparatus comprising:

means for progressing the drill into the medium until the drill is collared;

means for applying a given preset start-up value for each drilling parameter to the drill;

means for calculating the rate of penetration of the drill into such medium based upon the two parametric values being input into the drill;

means for continuously and alternatively applying automatic incremental changes in the value of one of the drilling parameters to the drill while keeping the other parameter value constant until the penetration rate is maximized for such one parameter being incrementally changed and for applying automatic incremental changes in the value of the other of the drilling parameters to the drill, while keeping the first parameter value constant, until the penetration rate is maximized for such second parameter being changed.

12. The apparatus according to claim 1 wherein the apparatus further includes means for automatically waiting a given time period between incremental changes in the values of the two drilling parameters before commencing yet another automatic incremental change in order to permit stabilization of the drilling system and procedure and in order to preclude inclusion within the calculation of the penetration rate of instabilities which occur as a result of nonlinear process dynamics.

13. The apparatus according to claim 12 wherein said means for automatically waiting a given time period is configured to provide a five second wait period between successive incremental changes to either of the two drilling parameters.

14. The apparatus according to claim 11 in which the means for applying the incremental changes to one of the parameters is configured to do so independently of the value of the other parameter being held constant.

15. The apparatus according to claim 11 in which the means for applying incremental changes in the values of both parameters is configured to provide increases as well as decreases in the value of the parameter being changed.

16. The apparatus according to claim 15 in which the means for applying incremental changes in the value of each parameter is operative to increase such input values until the calculated rate of penetration ceases to increase the means for applying incremental changes than being operative to decrease the parameter value or hold such value constant until the maximum calculated penetration rate stabilizes at a relative maximum for the two parameter values being input into the drill.

17. The apparatus according to claim 11 wherein the apparatus further includes means for periodically reading torque pressure to the drill and automatically overriding the last parameter incremental change when the change in torque is greater than a given preset value for preventing damage to the drill.

18. The apparatus according to claim 17 wherein said torque reading means overrides the last parameter incremental change when the change in torque is greater than 300 psi/sec.

19. The apparatus according to claim 11 wherein the means for calculating the rate of penetration of the drill into the medium includes means for providing a deadband area of insensitivity for the calculation of the penetration rate which precludes additional incremental changes in the parameter values due to minor instabilities which occur as a result of the nonlinear process dynamics of drilling.

20. The apparatus according to claim 11 wherein the means for applying incremental changes is configured to change the thrust values in increments of $\pm 100$ psi and the RPM parameter values in increments of $\pm 50$ RPM.

21. The apparatus according to claim 11 in which said means for progressing the drill into the medium until the drill is collared does so automatically without any manual operations.

22. The apparatus according to claim 11 in which said means for progressing the drill into the medium until the drill is collared does so as a result of manual input into said apparatus.

* * * * *

UNITED STATES PATENT AND TRADEMARK OFFICE

CERTIFICATE OF CORRECTION

PATENT NO. : 4,165,789

DATED : August 28, 1979

INVENTOR(S) : Charles D. Rogers

It is certified that error appears in the above-identified patent and that said Letters Patent are hereby corrected as shown below:

Column 9, line 42, change "for" to -- or --.

Column 10, line 13, after "hydraulic" add -- pressure --.

Column 12, line 63, change "1" to -- 11 --.

Column 13, line 24, change "than" to -- then --.

Signed and Sealed this

*Twenty-second* Day of *January 1980*

[SEAL]

*Attest:*

SIDNEY A. DIAMOND

*Attesting Officer*

*Commissioner of Patents and Trademarks*